US010735847B2

(12) United States Patent
Hsiao

(10) Patent No.: US 10,735,847 B2
(45) Date of Patent: Aug. 4, 2020

(54) EARPHONE

(71) Applicant: COOLER MASTER TECHNOLOGY INC., New Taipei (TW)

(72) Inventor: Shih-Hsiung Hsiao, New Taipei (TW)

(73) Assignee: COOLER MASTER TECHNOLOGY INC., New Taipei (TW)

( * ) Notice: Subject to any disclaimer, the term of this patent is extended or adjusted under 35 U.S.C. 154(b) by 0 days.

(21) Appl. No.: 16/155,699

(22) Filed: Oct. 9, 2018

(65) Prior Publication Data

US 2020/0059715 A1 Feb. 20, 2020

(30) Foreign Application Priority Data

Aug. 17, 2018 (TW) ..... 107211358 U

(51) Int. Cl.
*H04R 1/10* (2006.01)

(52) U.S. Cl.
CPC ..... *H04R 1/1041* (2013.01); *H04R 1/105* (2013.01); *H04R 1/1016* (2013.01); *H04R 2460/11* (2013.01)

(58) Field of Classification Search
CPC .... H04R 1/1041; H04R 1/1016; H04R 1/105; H04R 1/1058; H04R 1/1075; H04R 1/1066; H04R 5/0335; H04R 2460/11
See application file for complete search history.

(56) References Cited

U.S. PATENT DOCUMENTS 3,702,123 A * 11/1972 Macken ..... H04R 25/652 181/135
7,512,243 B2 * 3/2009 Haussmann ..... A61F 11/08 381/72
8,820,470 B2 * 9/2014 Brown ..... A61F 11/08 128/864
2012/0087511 A1 * 4/2012 Lumsden ..... A61F 11/08 381/74
2013/0058517 A1 * 3/2013 Lee ..... H04R 1/1066 381/380
2014/0198940 A1 * 7/2014 Lin ..... H04R 1/2807 381/345
2014/0226847 A1 * 8/2014 Yang ..... H04R 1/1058 381/380
2014/0286521 A1 * 9/2014 Yang ..... H04R 1/1041 381/380
2015/0237436 A1 * 8/2015 Wang ..... H04R 1/1091 381/380
2018/0199129 A1 * 7/2018 Zhao ..... H04R 1/1041

* cited by examiner

*Primary Examiner* — Fan S Tsang
*Assistant Examiner* — Angelica M McKinney
(74) *Attorney, Agent, or Firm* — Maschoff Brennan

(57) ABSTRACT

An earphone includes an earphone body and an adjustment assembly. The earphone includes a shell and a speaker unit. The shell has a chamber, an audio hole and a ventilation hole. The audio hole and the ventilation hole are connected to the chamber. The speaker unit is located in the chamber and is corresponding to the audio hole. The adjustment assembly includes a baffle and a button. The baffle is located in the chamber and is located between the speaker unit and the ventilation hole. The button is connected to the baffle and is movably disposed on the shell so that the baffle is movable to connect the ventilation hole to the chamber or to disconnect the ventilation hole from the chamber by the button.

20 Claims, 8 Drawing Sheets

EARPHONE

CROSS-REFERENCE TO RELATED APPLICATIONS

This non-provisional application claims priority under 35 U.S.C. § 119(a) on Patent Application No(s). 107211358 filed in Taiwan, R.O.C. on Aug. 17, 2018, the entire contents of which are hereby incorporated by reference.

TECHNICAL FIELD

The present disclosure relates to an earphone, more particularly to an earphone having an adjustment assembly.

BACKGROUND

Nowadays, electronic products, such as mobile phones, personal digital assistants (PDA) or laptop computers, are more lightweight and portable so that they are convenient for people to carry around. Sometimes, people would wear earphones to listen to the audio information provided by the electronic products.

However, there is not yet an earphone that contains an audio-adjusting mechanism that can adjust the sound feature. Therefore, some people would purchase multiple earphones respectively for different sound features, but it costs much money and is inconvenience.

SUMMARY

The present disclosure disclosing an earphone which is able to adjust the sound feature.

According to one aspect of the present disclosure, an earphone includes an earphone body and an adjustment assembly. The earphone includes a shell and a speaker unit. The shell has a chamber, an audio hole and a ventilation hole. The audio hole and the ventilation hole are connected to the chamber. The speaker unit is located in the chamber and is corresponding to the audio hole. The adjustment assembly includes a baffle and a button. The baffle is located in the chamber and is located between the speaker unit and the ventilation hole. The button is connected to the baffle and is movably disposed on the shell so that the baffle is movable to connect the ventilation hole to the chamber or to disconnect the ventilation hole from the chamber by the button.

According to another aspect of the present disclosure, an earphone includes an earphone body and an adjustment assembly. The earphone body includes a shell. The shell has an audio hole. The adjustment assembly includes a button. The button is disposed on a side of the earphone body facing away from the audio hole. The button is configured to be pressed toward the audio hole so as to adjust sound feature of the earphone body via an adjustment means.

According to the earphone discussed above, since the earphone includes the button that is movable and thus able to connect the ventilation hole to the chamber or to disconnect the ventilation hole from the chamber, such that the sound feature of the earphone can be adjusted by simply pressing the button.

Also, the button is disposed on a side of the earphone body facing away from the audio hole and the button is configured to be pressed toward the audio hole. This configuration allows the user to press the button while wearing the earphone.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
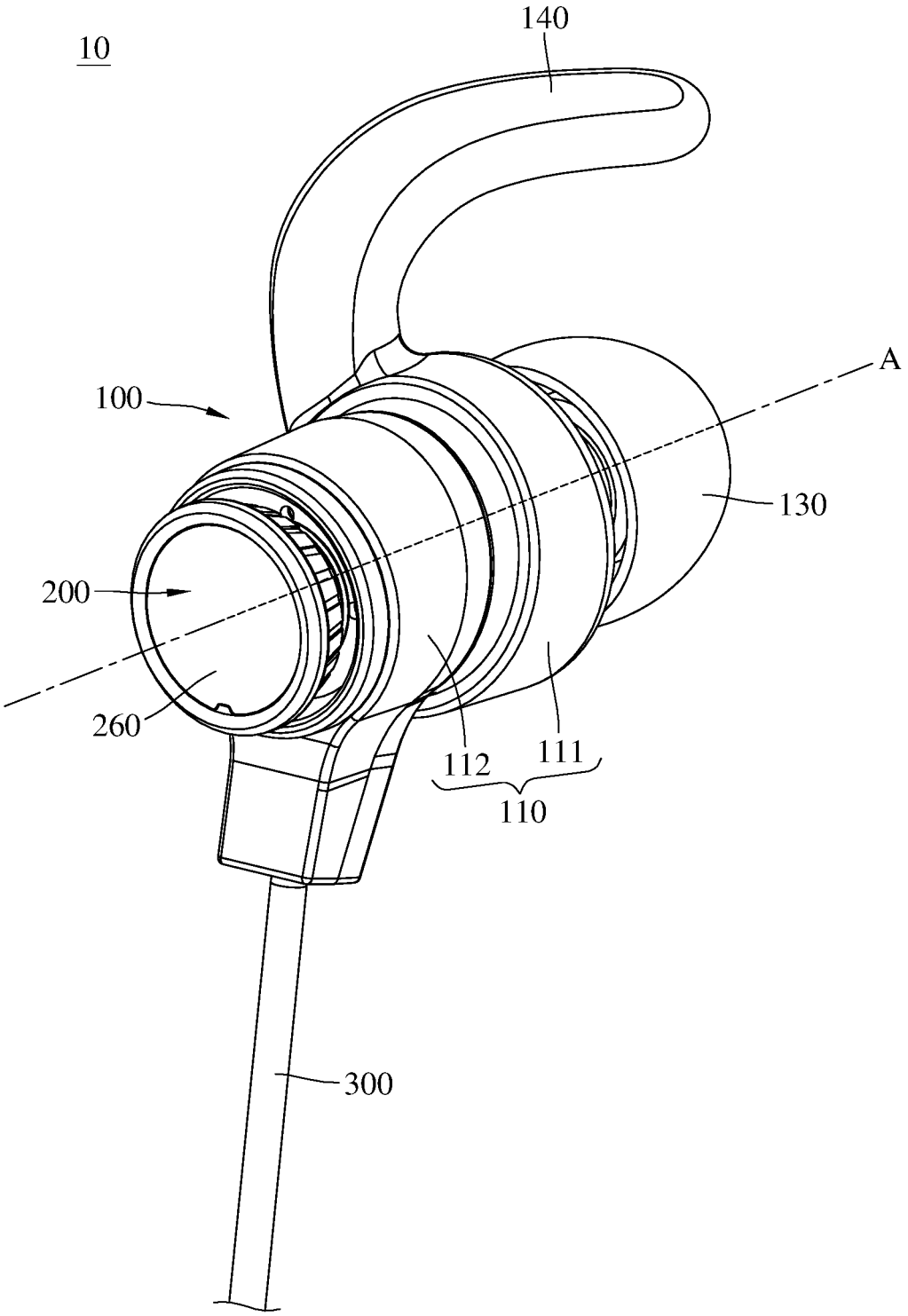
FIG. 1 is a perspective view of an earphone according to one embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
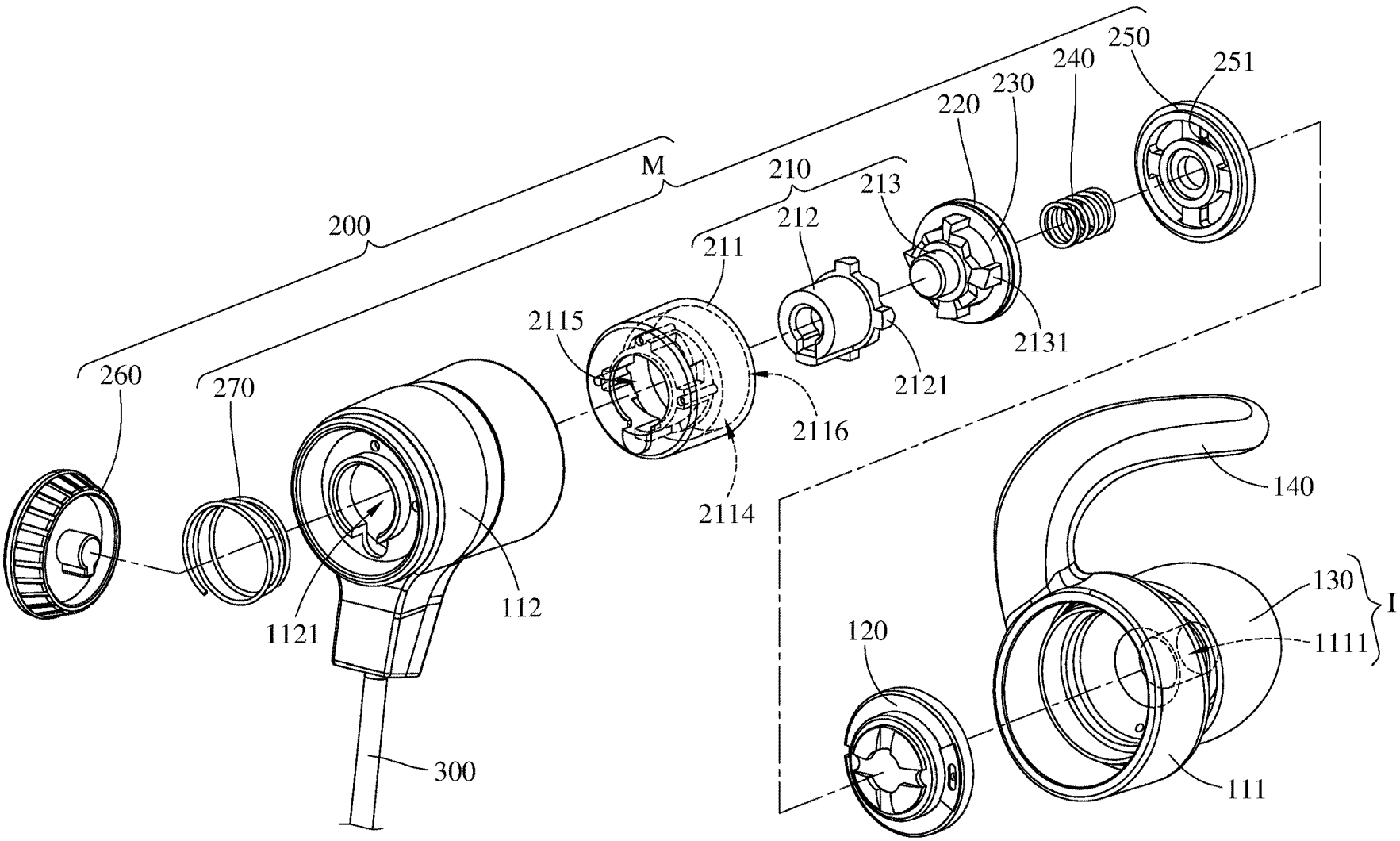
FIG. 2 is an exploded view of the earphone in FIG. 1.
Figure 3:
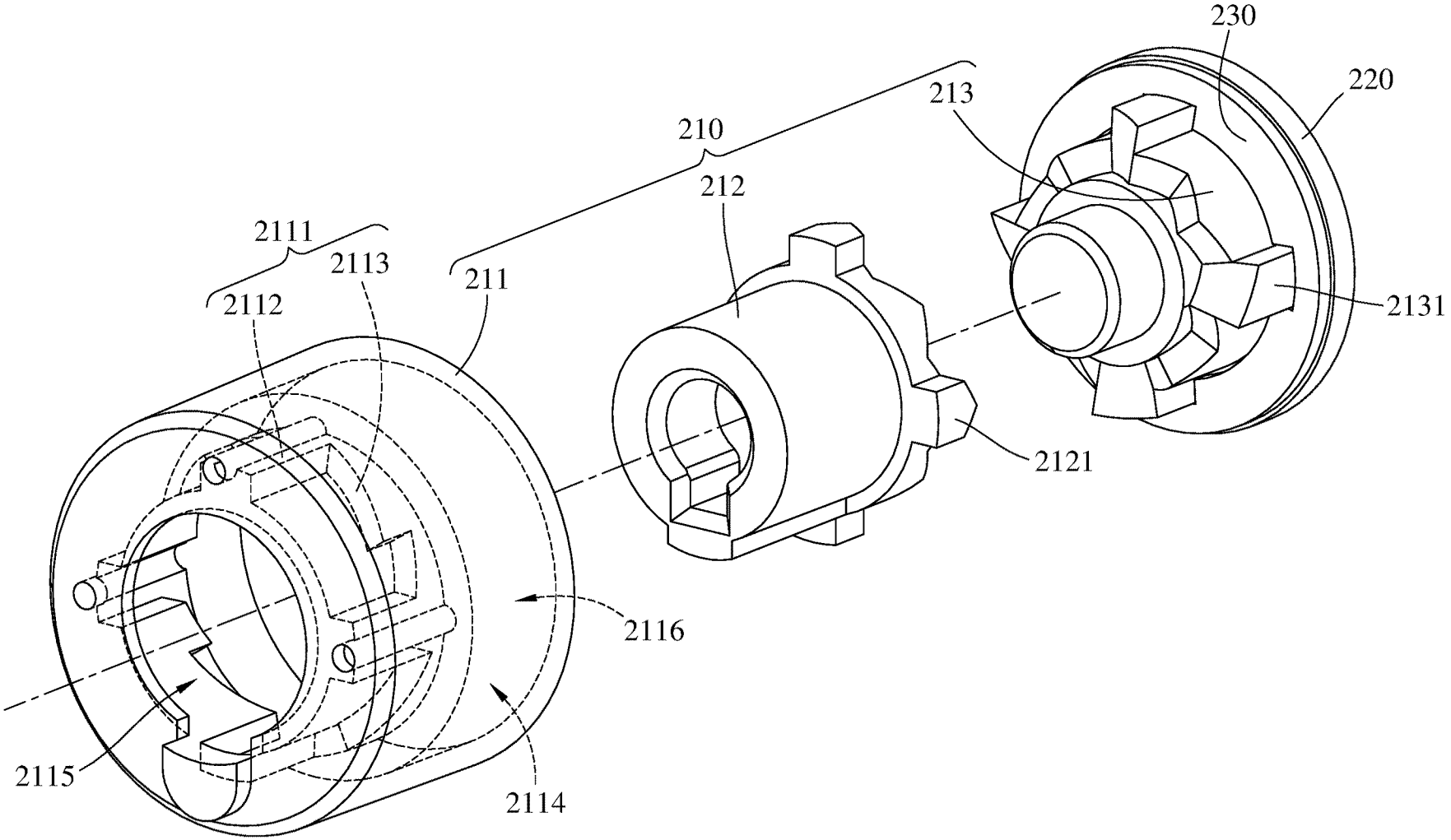
FIG. 3 is a partial enlarged exploded view of the earphone in FIG. 2.
Figure 4:
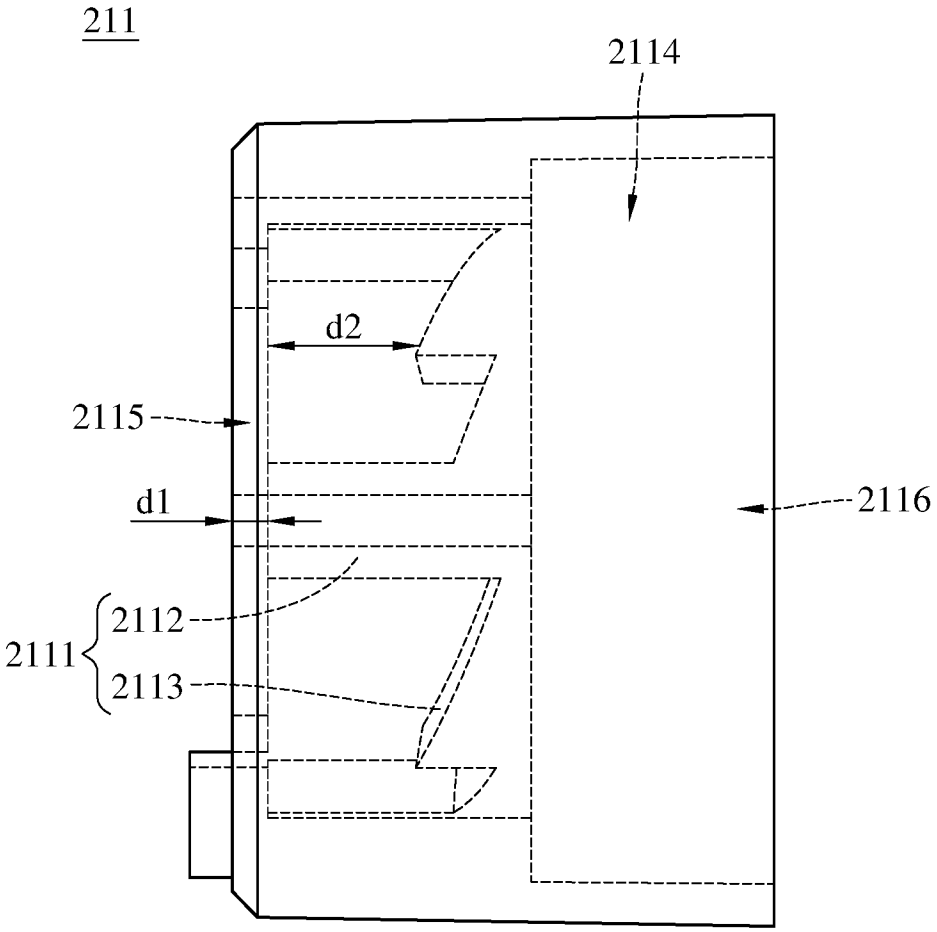
FIG. 4 is a side view of a cylindrical component according to the embodiment of the present disclosure.

Please refer to FIG. 1 to FIG. 6. FIG. 1 is a perspective view of an earphone according to one embodiment of the present disclosure. FIG. 2 is an exploded view of the earphone in FIG. 1. FIG. 3 is a partial enlarged exploded view of the earphone in FIG. 2. FIG. 4 is a side view of a cylindrical component according to the embodiment of the present disclosure. FIG.

Figure 6:
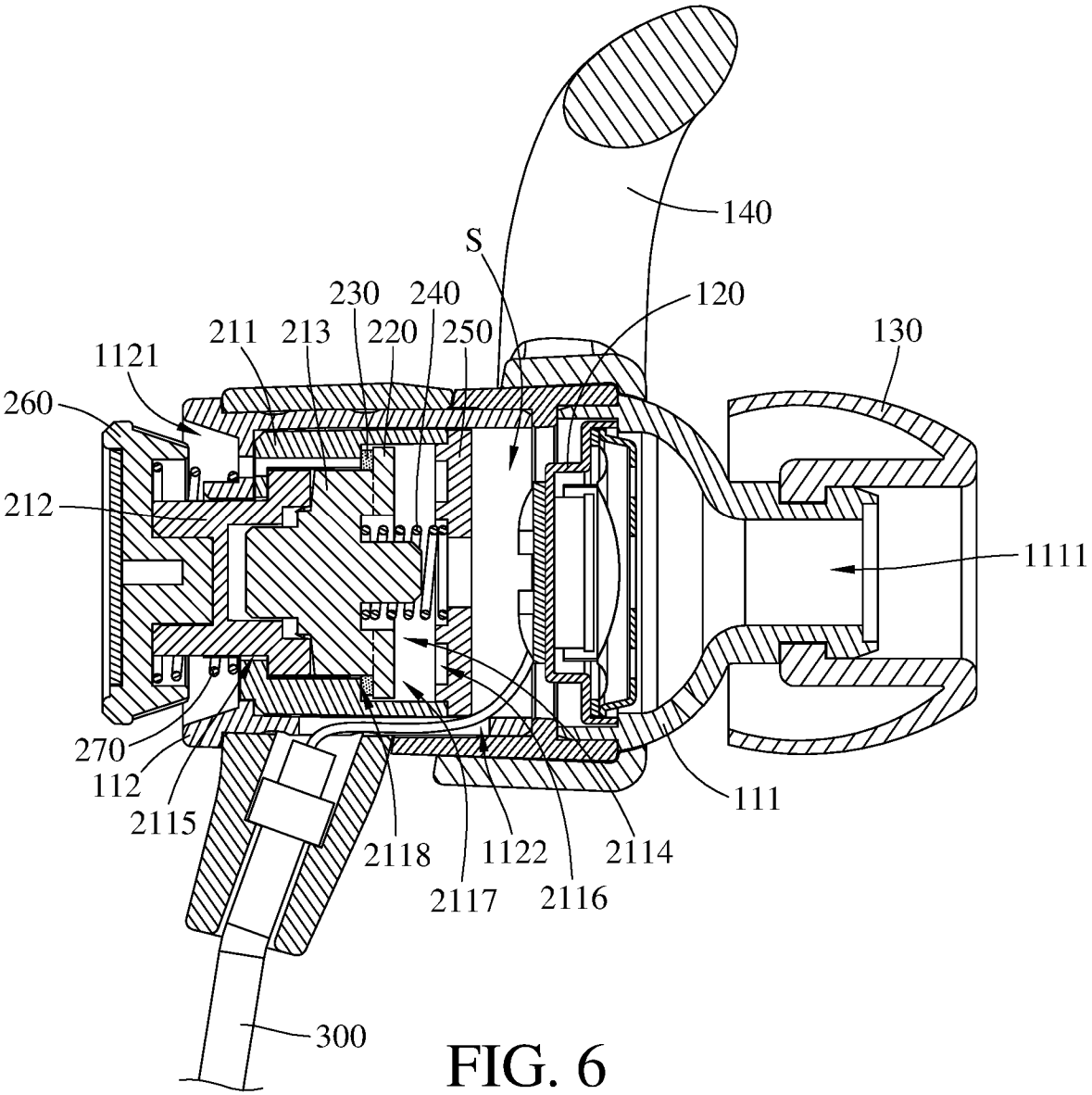
FIG. 6 is a side sectional view of the earphone in FIG. 1.

5 is a partial enlarged perspective view of the earphone in FIG. 1. FIG. 6 is a side sectional view of the earphone in FIG. 1.

In this embodiment, an earphone 10 is disclosed. The earphone 10 is, for example, an earbuds earphone. The earphone 10 includes an earphone body 100 and an adjustment assembly 200. The earphone body 100 includes a shell 110 and a speaker unit 120. The shell 110 is substantially in a cylindrical shape. The so-called cylindrical shape may be a straight cylinder, an oblique cylinder, a twisted cylinder, a concave cylinder, a convex cylinder or a cone. The shell 110 includes a first shell 111 and a second shell 112. The first shell 111 and the second shell 112 are assembled together so as to form a chamber S therebetween. The first shell 111 has an audio hole 1111 which is located at a side of the first shell 111 far away from the second shell 112 and is connected to the chamber S. The second shell 112 has a ventilation hole 1121 which is located at a side of the second shell 112 far away from the first shell 111 and is connected to the chamber S. The speaker unit 120 is located in the chamber S and is corresponding to the audio hole 1111, such that sound produced by the speaker unit 120 is able to be transmitted out of the earphone body 100 via the audio hole 1111.

In this embodiment, the earphone body 100 further includes an earbud 130 and an ear wing 140. The earbud 130 is disposed at the audio hole 1111 of the first shell 111, and the earbud 130 and part of the first shell 111 together form an in-ear part I. The in-ear part I is the part of the earphone body 100 being inserted into the human ear canal.

The ear wing 140 is connected to the first shell 111 and is configured to be locked on the auricle, such that the earphone 10 can be secured in place to avoid falling.

The adjustment assembly 200 includes a push-push mechanism 210, a baffle 220, a gasket 230, a first elastic component 240, a cover 250, a button 260 and a second elastic component 270. The push-push mechanism 210 is located in the chamber S. The push-push mechanism 210 includes a cylindrical component 211, a pushing component 212 and a pivotable component 213. The cylindrical component 211 has multiple guide grooves 2111 located on an inner wall (not numbered) thereof. Each guide groove 2111 has a release portion 2112 and a stop portion 2113, the release portion 2112 extends along a longitudinal direction of the cylindrical component 211, and the stop portion 2113 and the release portion 2112 are arranged along a circumferential direction of the cylindrical component 211. The stop portions 2113 are located farther away from the ventilation hole 1121 than the release portions 2112. In addition, the cylindrical component 211 further has a ventilation channel 2114, a first opening 2115, and a second opening 2116. The first opening 2115 and the second opening 2116 are connected to the ventilation channel 2114. The first opening 2115 is closer to the ventilation hole 1121 than the second opening 2116. A distance dl between the release portions 2112 and the plane in which the first opening 2115 is located is smaller than a distance d2 between the stop portions 2113 and the plane in which the first opening 2115 is located.

The pushing component 212 has multiple first guide blocks 2121. The first guide blocks 2121 are respectively slidably located in the release portions 2112 of the guide grooves 2111. The pivotable component 213 has multiple second guide blocks 2131. The second guide blocks 2131 are respectively slidably located in the release portions 2112. The pushing component 212 is able to push the pivotable component 213 toward the speaker unit 120 so as to move the second guide blocks 2131 of the pivotable component 213 to the stop portions 2113 or the release portions 2112 with the guide of the guide grooves 2111.

In this embodiment, the amount of the guide grooves 2111, the first guide blocks 2121 and the second guide blocks 2131 are not restricted. For example, in other embodiments, the cylindrical component may only have one guide groove, one first guide block and one second guide block.

The baffle 220 is located in the chamber S and is located between the speaker unit 120 and the ventilation hole 1121. The baffle 220 is connected to a side of the pivotable component 213 which is facing away from the pushing component 212. In this embodiment, the baffle 220 and the pivotable component 213 are made of a single piece. The movement of the pivotable component 213 is able to push the baffle 220 toward the audio hole 1111. The gasket 230 is attached to a side of the baffle 220 facing the cylindrical component 211.

In this embodiment, the cylindrical component 211 further has an annular groove 2117 at the second opening 2116 and an annular lateral surface 2118 which is located on a side of the annular groove 2117 and faces toward the in-ear part I. The cover 250 has at least one air passage 251. The cover 250 is disposed on a side of the cylindrical component 211 facing the speaker unit 120. The first elastic component 240 is clamped between the cover 250 and the pivotable component 213 and is configured to force the pivotable component 213 and the baffle 220 to move toward the pushing component 212. When the second guide blocks 2131 of the pivotable component 213 are respectively located in the release portions 2112 of the guide grooves 2111, the baffle 220 and the gasket 230 are located in the annular groove 2117, and the gasket 230 is being forced to press against the annular lateral surface 2118 so as to secure the air tightness of the chamber S.

The button 260 is disposed on a side of the pushing component 212 facing away from the in-ear part I. The second elastic component 270 is, for example, a coil spring and is clamped between the button 260 and the second shell 112 so as to force the button 260 to separate from the second shell 112. When the second guide blocks 2131 of the pivotable component 213 are respectively located in the stop portions 2113 of the guide grooves 2111, the first guide blocks 2121 of the pushing component 212 are still slidable respectively in the release portions 2112 of the guide grooves 2111. Thus, the second elastic component 270 is configured to normally force the button 260 to move away from the second shell 112 so as to prevent the button 260 from sliding with the pushing component 212 and hitting the second shell 112 with noise.

There is an axis A located on a longitudinal direction crossing a center point (not shown) of the shell 110. The button 260 and the in-ear part I are respectively located at two opposite sides of the shell 110 and both of them are located on the axis A. This configuration allows the user to press the button 260 in a direction toward the in-ear part I to adjust the sound feature while wearing the earphone 10.

In this embodiment, the earphone body 100 has an earbud 130, but the disclosure is not limited thereto. In other embodiments such as an earmuff headphone or a hook earphone, there is no earbud and the sound feature still can be adjust by simply pressing the button.

In this embodiment, the second shell 112 has an indentation 1122 on an inner wall (not numbered) thereof. A signal transmission line 300 is disposed through the indentation 1122 and is electrically connected to the speaker unit 120. The indentation 1122 provides a space for containing the signal transmission line 300 so as to protect the signal transmission line 300 from interfering with the adjustment assembly 200 during the movement of the adjustment assembly 200.

Figure 7:
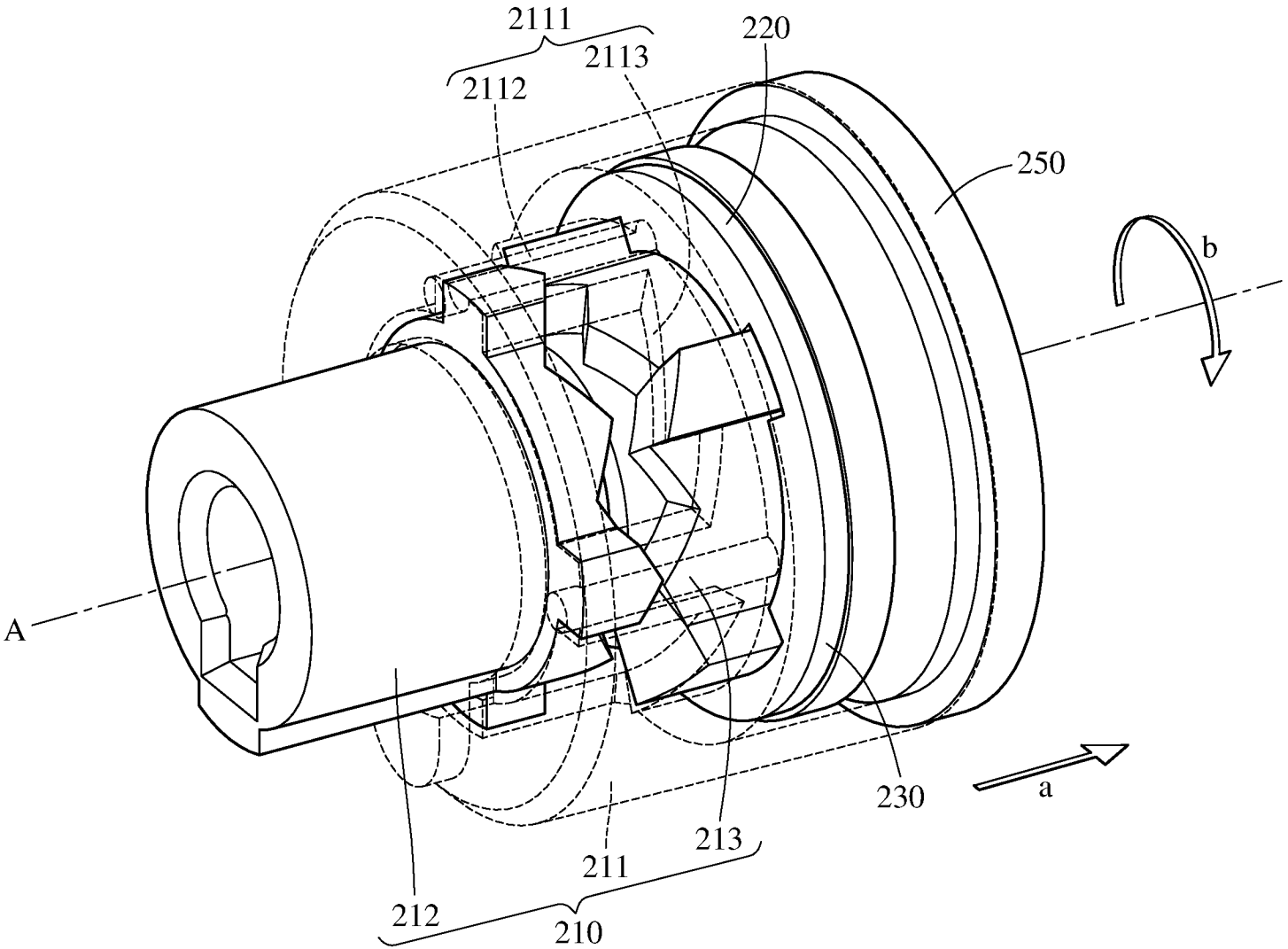
FIG. 7 to FIG. 8 are schematic views showing the operation of the earphone in FIG. 1.
Figure 8:
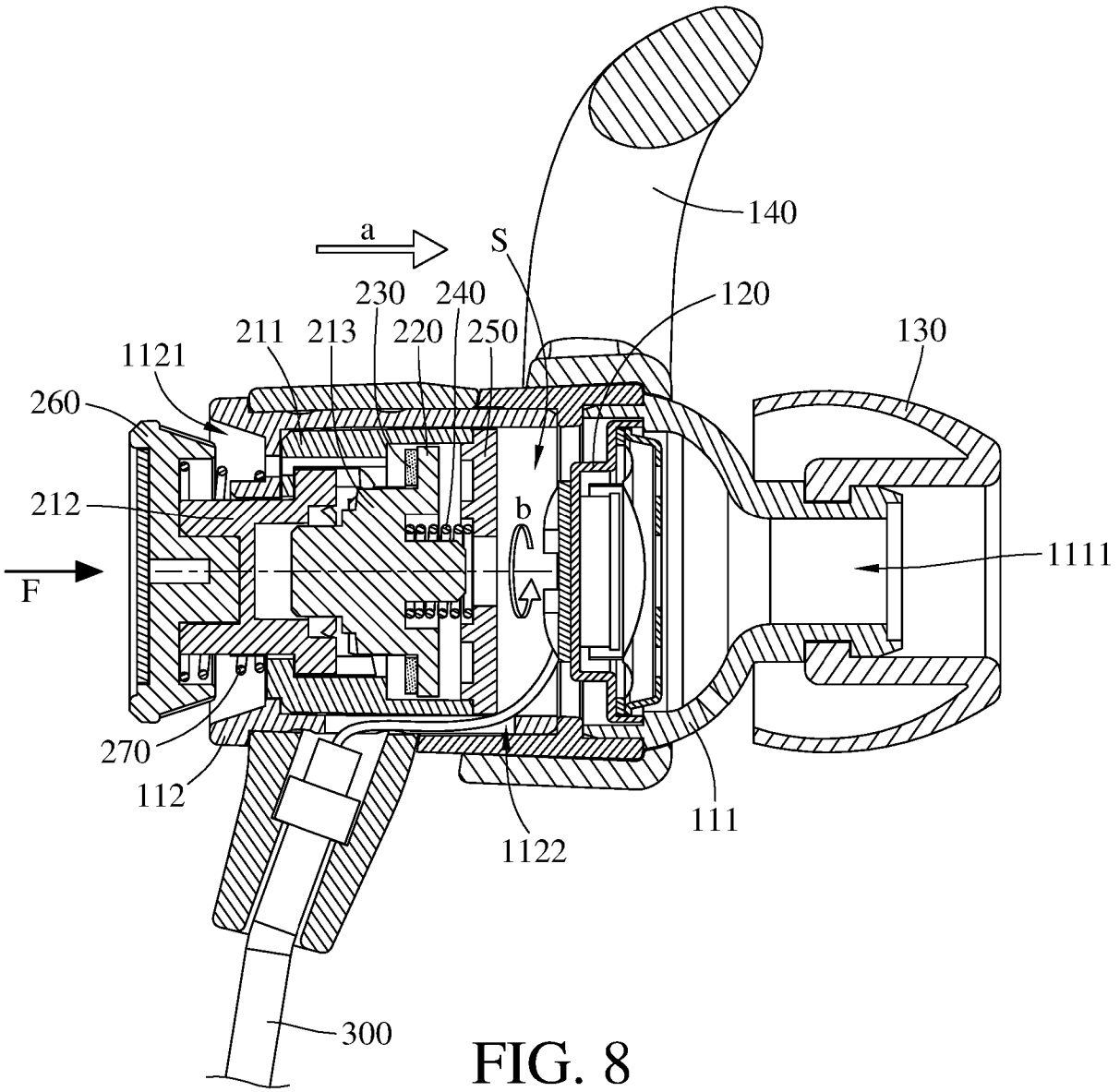

Then, please refer to FIG. 5 to FIG. 8, wherein FIG. 7 to FIG. 8 are schematic views showing the operation of the earphone in FIG. 1.

Figure 5:
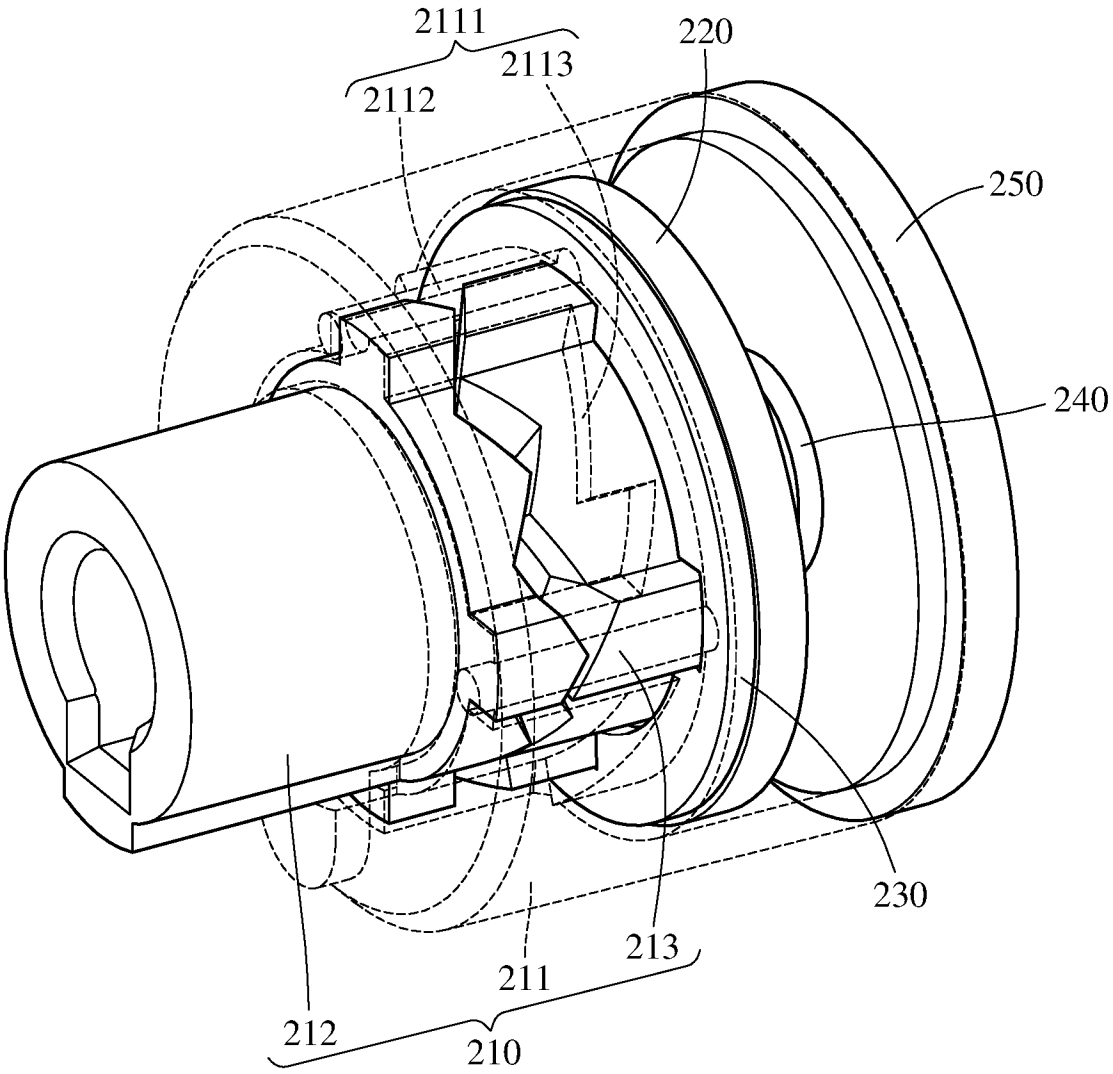
FIG. 5 is a partial enlarged perspective view of the earphone in FIG. 1.

As shown in FIG. 5 and FIG. 6, the second guide blocks 2131 of the pivotable component 213 are respectively located in the release portions 2112 of the guide grooves 2111 and the baffle 220 connected to the pivotable component 213 covers the second opening 2116 so as to disconnect the ventilation hole 1121 from the chamber S.

As shown in FIG. 7 and FIG. 8, when a force F is applied to the button 260 and forces it to move along a direction a, the button 260 forces both the pushing component 212 and the pivotable component 213 to move along the direction a, then move the second guide blocks 2131 out of the release portions 2112, and then the second guide blocks 2131 are moved to the stop portions 2113 of the guide grooves 2111 so as to cause the pivotable component 213 to pivot along a direction b. The distance between the stop portions 2113 and the first opening 2115 is larger than the distance between the release portions 2112 and the first opening 2115, thus the baffle 220 is separated from the annular lateral surface 2118 when the second guide blocks 2131are respectively located in the stop portions 2113. By separating the baffle 220 from the annular lateral surface 2118, the ventilation hole 1121 is connected to the chamber S so as to change sound feature. As such, the sound feature of the earphone 10 is adjustable by simply pressing the button 260.

In this embodiment, the configuration of the push-push mechanism 210, the baffle 220, the gasket 230, the first elastic component 240, the cover 250 and the second elastic component 270 is an adjustment means M by which the button 260 can be pressed toward the audio hole 1111 so as to adjust sound feature of the earphone body 100.

The above adjustment means M that achieves the press-to-change sound feature is not limited to be adapted to the earbuds earphone. For example, in other embodiments, the above adjustment means M may be adapted to a hook earphone or an earmuff headphone that has no earbuds.

In this embodiment, the aforementioned adjustment means M is configured to connect the ventilation hole 1121 to the chamber S or to disconnect the ventilation hole 1121 from the chamber S, but the disclosure is not limited thereto. In other embodiments, the adjustment means M may be able to change the aperture size of the ventilation hole or to activate an electrical switch for changing the sound feature.

According to the earphone discussed above, since the earphone includes the button that is movable and thus able to connect the ventilation hole to the chamber or to disconnect the ventilation hole from the chamber, such that the sound feature of the earphone can be adjusted by simply pressing the button.

Also, the button is disposed on a side of the earphone body facing away from the audio hole and the button is configured to be pressed toward the audio hole. This configuration allows the user to press the button while wearing the earphone.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. An earphone, comprising:

an earphone body, comprising a shell and a speaker unit, the shell having a chamber, an audio hole and a ventilation hole, the audio hole and the ventilation hole both connected to the chamber, the speaker unit located in the chamber, and the speaker corresponding to the audio hole; and an adjustment assembly, comprising a baffle, a push-push mechanism and a button, the baffle located in the chamber and located between the speaker unit and the ventilation hole, the push- push mechanism located in the chamber, and the button connected to the baffle via the push-push mechanism and movably disposed on the shell so that the baffle is movable with respect to the shell by the push-push mechanism which is moved by the button, and the baffle is movable to connect the ventilation hole to the chamber or to disconnect the ventilation hole from the chamber by the button;

wherein the push-push mechanism comprises a cylindrical component, a pushing component and a pivotable component, the cylindrical component has at least one guide groove, the at least one guide groove has a release portion and a stop portion, the release portion extends along a longitudinal direction of the cylindrical component, the release portion and the stop portion are arranged along a circumferential direction of the cylindrical component, the stop portion is located farther away from the ventilation hole than the release portion, the pushing component has at least one first guide block which is slidably located in the release portion of the at least one guide groove, the pivotable component is connected to the baffle and has at least one second guide block which is slidably located in the release portion, the button is disposed on the pushing component; when the button forces the pushing component to push the pivotable component, the at least one second guide block of the pivotable component is guided by the at least one guide groove so as to be moved to the stop portion or the release portion.

2. The earphone according to claim 1, wherein the cylindrical component has a ventilation channel, a first opening and a second opening, the first opening and the second opening are connected to the ventilation channel, the first opening is located closer to the ventilation hole than the second opening; when the at least one second guide block of the pivotable component is located in the release portion of the at least one guide groove, the baffle covers the second opening so as to disconnect the ventilation hole from the chamber; when the at least one second guide block of the pivotable component is located in the stop portion of the at least one guide groove, the baffle is separated from the cylindrical component so as to connect the ventilation hole to the chamber.

3. The earphone according to claim 2, wherein the cylindrical component has an annular groove at the second opening; when the at least one second guide block of the pivotable component is located in the release portion of the at least one guide groove, the baffle is located at the annular groove.

4. The earphone according to claim 1, wherein the adjustment assembly further comprises a gasket which is attached to a side of the baffle facing the cylindrical component.

5. The earphone according to claim 1, wherein the adjustment assembly further comprises a cover and a first elastic component, the cover has at least one air passage and is disposed on the cylindrical component, and the first elastic component is clamped between the cover and the pivotable component so as to force the pivotable component to move toward the pushing component.

6. The earphone according to claim 5, wherein the adjustment assembly further comprises a second elastic component which is clamped between the button and the shell so as to force the button to move away from the shell.

7. The earphone according to the claim 1, wherein the earphone body further comprises an earbud, the shell comprises a first shell and a second shell, the first shell and the second shell are assembled together so as to form a chamber therebetween, the audio hole is located at a side of the first shell facing away from the second shell, the ventilation hole is located at a side of the second shell facing away from the first shell, and the earbud is disposed at the audio hole.

8. The earphone according to the claim 7, wherein the earphone body further comprises an ear wing which is connected to the first shell.

9. The earphone according to the claim 7, further comprises a signal transmission line, the second shell has an indentation, and the signal transmission line is disposed through the indentation and is electrically connected to the speaker unit.

10. An earphone, comprising:

an earphone body, comprising a shell, and the shell having an audio hole, a ventilation hole and a chamber; and an adjustment assembly, comprising a button, a push-push mechanism and a baffle, the button disposed on a side of the earphone body facing away from the audio hole, the push-push mechanism and the baffle located in the chamber, and the button being connected to the baffle via the push-push mechanism and configured to be pressed toward the audio hole so that the baffle is movable to connect the ventilation hole to the chamber or disconnect the ventilation hole from the chamber via the push-push mechanism so as to adjust sound feature of the earphone body;

wherein the push-push mechanism comprises a cylindrical component, a pushing component and a pivotable component, the cylindrical component has at least one guide groove, the at least one guide groove has a release portion and a stop portion, the release portion extends along a longitudinal direction of the cylindrical component, the release portion and the stop portion are arranged along a circumferential direction of the cylindrical component, the stop portion is located farther away from the ventilation hole than the release portion, the pushing component has at least one first guide block which is slidably located in the release portion of the at least one guide groove, the pivotable component is connected to the baffle and has at least one second guide block which is slidably located in the release portion, and the button is disposed on the pushing component; the button forces the pushing component to support the pivotable component, the at least one second guide block of the pivotable component is guided by the at least one guide groove so as to be moved to the stop portion or the release portion.

11. The earphone according to the claim 10, wherein the shell is in a shape of a straight cylinder, an oblique cylinder, a twisted cylinder, a concave cylinder, a convex cylinder or a cone, the audio hole and the button are respectively located at two opposite sides of the shell, and both of the audio hole and the button are located on an axis of the shell.

12. The earphone according to the claim 10, wherein the earphone body has an in-ear part, and the audio hole is located at the in-ear part.

13. The earphone according to claim 10, wherein the cylindrical component has a ventilation channel, a first opening and a second opening, the first opening and the second opening are connected to the ventilation channel, the first opening is closer to the ventilation hole than the second opening; when the at least one second guide block of the pivotable component is located in the release portion of the at least one guide groove, the baffle covers the second opening so as to disconnect the ventilation hole from the chamber; when the at least one second guide block of the pivotable component is located at the stop portion of the at least one guide groove, the baffle is separated from the cylindrical component so as to connect the ventilation hole and the chamber through the second opening.

14. The earphone according to claim 13, wherein the cylindrical component has an annular groove at the second opening; when the at least one second guide block is located in the release portion of the at least one guide groove, the baffle is located at the annular groove.

15. The earphone according to claim 10, wherein the adjustment assembly further comprises a gasket which is attached to a side of the baffle facing the cylindrical component.

16. The earphone according to claim 10, wherein the adjustment assembly further comprises a cover and a first elastic component, the cover has at least one air passage and is disposed on the cylindrical component, and the first elastic component is clamped between the cover and the pivotable component so as to force the pivotable component to move toward the pushing component.

17. The earphone according to claim 16, wherein the adjustment assembly further comprises a second elastic component which is clamped between the button and the shell so as to force the button to move away from the shell.

18. The earphone according to the claim 10, wherein the earphone body further comprises an earbud, the shell comprises a first shell and a second shell, the first shell and the second shell are assembled together so as to form a chamber therebetween, the audio hole is located at a side of the first shell away from the second shell, and the earbud is disposed at the audio hole.

19. The earphone according to the claim 18, wherein the earphone body further comprises an ear wing which is connected to the first shell.

20. The earphone according to the claim 18, further comprises a signal transmission line, the second shell has an indentation, and the signal transmission line disposed through the indentation and is electrically connected to a speaker unit of the earphone body.

* * * * *